US008159509B2

(12) United States Patent
Kanou

(10) Patent No.: US 8,159,509 B2
(45) Date of Patent: Apr. 17, 2012

(54) COLOR DISPLAY DEVICE AND METHOD FOR REPRODUCING COLOR WITH AN INCREASED NUMBER OF GRADATION LEVELS

(75) Inventor: Hideki Kanou, Tokyo (JP)

(73) Assignee: Oki Semiconductor Co., Ltd. (JP)

( * ) Notice: Subject to any disclaimer, the term of this patent is extended or adjusted under 35 U.S.C. 154(b) by 1028 days.

(21) Appl. No.: 12/057,875

(22) Filed: Mar. 28, 2008

(65) Prior Publication Data

US 2008/0238952 A1 Oct. 2, 2008

(30) Foreign Application Priority Data

Mar. 30, 2007 (JP) ..... 2007-92526

(51) Int. Cl.
*G09G 5/10* (2006.01)

(52) U.S. Cl. ..... 345/690; 345/88; 345/89; 345/694

(58) Field of Classification Search ..... 345/87, 345/89, 690, 694, 695, 698
See application file for complete search history.

(56) References Cited

U.S. PATENT DOCUMENTS

| | | | | |
|---|---|---|---|---|
| 5,629,743 | A | 5/1997 | Lee et al. | |
| 6,356,277 | B1 * | 3/2002 | Yajima et al. | 345/603 |
| 7,277,075 | B1 | 10/2007 | Hirano et al. | |
| 2004/0021677 | A1 * | 2/2004 | Sasaki et al. | 345/694 |
| 2004/0222999 | A1 * | 11/2004 | Choi et al. | 345/589 |
| 2005/0122294 | A1 * | 6/2005 | Ben-David et al. | 345/87 |
| 2005/0190198 | A1 * | 9/2005 | Koyama | 345/593 |
| 2006/0256054 | A1 * | 11/2006 | Baek | 345/88 |
| 2006/0290831 | A1 | 12/2006 | You | |
| 2007/0171218 | A1 * | 7/2007 | Hong et al. | 345/211 |
| 2009/0058873 | A1 | 3/2009 | Brown Elliott et al. | |

FOREIGN PATENT DOCUMENTS

| | | |
|---|---|---|
| JP | 3-65865 | 3/1991 |
| JP | 3-201695 | 9/1991 |
| JP | 8-43791 | 2/1996 |
| JP | 2000-330522 | 11/2000 |
| JP | 2000-330523 | 11/2000 |
| JP | 2001147666 A | 5/2001 |
| JP | 2006171049 A | 6/2006 |
| JP | 2006259135 A | 9/2006 |

(Continued)

OTHER PUBLICATIONS

Japanese Office Action "Decision of Dismissal of Amendments" with mailing date of Jan. 5, 2010; Patent application No. 2007-092526 with English translation.

Shuhei Horibe; "Notification of Reason for Refusal"; JP2007-092526; Feb. 3, 2009.

(Continued)

*Primary Examiner* — Amare Mengistu
*Assistant Examiner* — Koosha Sharifi-Tafreshi
(74) *Attorney, Agent, or Firm* — Studebaker & Brackett PC; Donald R. Studebaker

(57) ABSTRACT

A color display device has a display screen having pixels arrayed, each of which is composed of primary color sub-pixels capable of reproducing respective primary colors and at least one subsidiary color sub-pixel capable of reproducing gray. While gradation signals are generated and supplied to the primary color sub-pixels on the basis of the primary color components of an image to be displayed, the gradation signal to be supplied to the subsidiary color sub-pixel is generated on the basis of the intensity component of the image. The color display device is attained in which the number of gradation levels can be substantially increased without increasing the number of gradation levels of the primary colors.

12 Claims, 7 Drawing Sheets

FOREIGN PATENT DOCUMENTS

| | | | | |
|---|---|---|---|---|
| JP | 2006267826 | A | | 10/2006 |
| JP | 2007004172 | A | | 1/2007 |
| WO | WO 03/088203 | A1 | | 10/2003 |
| WO | WO 2005091263 | A1 | * | 9/2005 |
| WO | 2006 127555 | A2 | | 11/2006 |

OTHER PUBLICATIONS

Japanese Office Action "Notification of Reason for Refusal" dated Aug. 6, 2009; Patent Application No. 2007-092526; with Extract Translation.

* cited by examiner

COLOR DISPLAY DEVICE AND METHOD FOR REPRODUCING COLOR WITH AN INCREASED NUMBER OF GRADATION LEVELS

BACKGROUND OF THE INVENTION

1. Field of the Invention

The present invention relates to a color display device and a color display method for reproducing color with an increased number of gradation levels, and more specifically to the configuration of sub-pixels forming a pixel and the generation of image data to be supplied to the sub-pixels in a color display device such as a liquid crystal display device. In particular, the present invention relates to the configuration of sub-pixels for reproducing subsidiary colors for compensating, for example, the three RGB (red, green and blue) primary colors and the generation and transfer of the subsidiary color data.

2. Description of the Background Art

Generally, a color display device such as a liquid crystal display (LCD) device is made up of a number of pixels or picture elements each of which is composed of three sub-pixels corresponding to the three primary colors, RGB, in order to represent the color of a pixel by a combination of the three primary colors. In this connection, International Publication No. WO 03/088203 A1 to Roth et al., discloses a technique of expanding the range of color reproducible by the use of one or more primary color(s) in addition to the RGB colors. Examples of such an additional primary color or colors may be yellow, cyan and/or magenta.

In this case, the number of possible colors is determined by the number of different gradation, or intensity, levels which can be reproduced by each sub-pixel. For example, in the case where each sub-pixel can reproduce 256 different gradation levels, thus by eight bits, the number of possible colors reproduced by the RGB (i.e. three) sub-pixels is equal to 256 cubed, i.e. about 16.7 millions in combination. In general, the gradation level of each of the sub-pixels is controlled by varying the voltage applied to the corresponding LCD cell to adjust the optical transmittance of that sub-pixel. This voltage is applied by a driving device. In the following, such a driving device is referred to as an LCD driver. Needless to say, the number of colors which can be reproduced increases as the number of gradation levels increases.

The number of gradation levels is determined by how fine the steps, i.e. the resolution, of a driver voltage an LCD driver supplies are designed.

If the resolution is increased, then the number of gradation levels, or colors reproducible, can be increased. However, for example, if the number of gradation levels is increased from 256 different gradation levels, requiring eight bits, to 1024 different gradation levels, requiring ten bits, then the number of circuit components such as selectors of the LCD driver increases in proportion to the number of gradation levels so that the circuitry of the LCD driver becomes complicated to increase the burden on designing, manufacturing and so forth. Furthermore, in this case, the voltage step per gradation, i.e. the step defined by the least significant bit (LSB), is decreased so that the deviation in voltage is more restrictive.

Another problem is related to the requirement that the three RGB primary colors are to be differently controlled in the case of the LCD device. This is because the three RGB primary colors have their own optical transmittance versus voltage characteristics respectively. Accordingly, it is necessary to provide the information about three curves indicating the transmittance versus voltage characteristics in correspondence with the respective, three RGB primary colors.

However, if the three RGB primary colors are finely or individually controlled with respect to the gradation levels, the circuit scale of the LCD driver is significantly increased, and thereby the requirement for high accuracy in controlling the gradation voltages entails an increase in production costs.

Taking into consideration the above circumstances, it is an object of the present invention to provide a color display device and a color display method in which the number of gradation levels can be substantially increased without increasing the number of gradation levels of the primary colors, e.g. without enhancing the resolution of the voltage applied to the color display panel by the LCD driver.

Furthermore, there is the following problem in the technique disclosed by Roth et al., stated above. While a color display device reproduces an arbitrary color by a combination of the three RGB primary colors in usual cases, it is proposed in the above publication to use a subsidiary color or colors in addition to the three RGB primary colors in order to reproduce with a high degree of accuracy particular colors which cannot accurately be reproduced only by a combination of the three RGB primary colors. In this case, the subsidiary color is attained by providing a color filter on a subsidiary pixel of the liquid crystal panel. RGB data is generated by converting a luminance signal and color-difference or chrominance signals by a graphics processor which receives or generates the image data to be displayed on the liquid crystal display device. The graphics processor outputs the RGB data to a timing controller. The timing controller arrays pixel values of the RGB data onto each horizontal line and transfers them to the LCD driver provided on the LCD panel. The timing controller also generates other signals necessary for displaying an image on the liquid crystal display device.

The luminance signal and color-difference signals can be converted into the RGB data, for example, in accordance with the following expressions.

$$R=1.164*(Y-16)+1.596*(Cr-128)$$

$$G=1.164*(Y-16)-0.391*(Cb-128)-0.813*(Cr-128)$$

$$B=1.164*(Y-16)+2.018*(Cr-128)$$

In the above expressions, Y is a luminance signal, and Cr and Cb are color-difference signals. By this conversion, the color information out of the RGB gamut is substantially discarded from the luminance signal and the color-difference signals. This is referred to as clipping. A subsidiary color can be generated from the data which is discarded by the clipping. However, the discarded data as it is cannot be used as data of the subsidiary color. A very complicated algorithm is necessary for making use of the discarded data as the subsidiary color.

Taking into consideration the above circumstances, it is also an object of the present invention to provide a color display device and a color display method in which data required for driving the subsidiary sub-pixels can be generated by a simplified process.

SUMMARY OF THE INVENTION

In accordance with the present invention, a color display device is operable to display at least three primary colors and at least one subsidiary color different from the primary colors, wherein the subsidiary color is displayed as a color corresponding to luminance information. By this configuration, the number of effective gradation levels is increased on the basis of the luminance information by making use of the subsidiary color corresponding to the luminance information, so that it is possible to substantially increase the number of gradation levels without increasing the number of gradation levels of the primary colors. The luminance information is substantially of gray and variable from white to black.

Preferably, in accordance with the present invention, there are sub-pixels capable of reproducing the respective primary colors and a sub-pixel(s) capable of reproducing the subsidiary color to form a pixel in combination. In other words, if the primary colors are RGB, then three subsidiary sub-pixels are provided for displaying subsidiary colors in correspondence with the sub-pixels of the RGB primary colors so that each pixel is composed of six sub-pixels to form one dot of a color display screen. The words "pixel" and "sub-pixel" should be comprehended in the current specification as not only an abstract dot or sample in imagewise information but also a real cell, i.e. physical device element forming the image display screen of an image display unit.

In this case, the subsidiary sub-pixels for displaying subsidiary colors can be controlled independently from each other with respect to their gradation levels. Specifically, by using these subsidiary sub-pixels, each of the RGB colors can be adjusted more finely, whereas RGB sub-pixels reproduce only common particular colors in correspondence with their optical transmittance versus voltage characteristics.

A pixel may alternatively be composed of sub-pixels capable of reproducing the respective primary colors and one subsidiary sub-pixel capable of reproducing the subsidiary color in association with the sub-pixels capable of reproducing the respective primary colors. In the case of the three RGB primary colors, one subsidiary sub-pixel is associated with three RGB sub-pixels so that each pixel is composed of four sub-pixels to form one dot of a color display screen.

In accordance with the present invention, the generation of subsidiary color data can be simplified by the use of the luminance information input to, or generated by, the color display device in the form of luminance signal for use in generating the subsidiary color data. The luminance signal can be used as it is or with some correction. That is to say, the data for use in reproducing the subsidiary color can be easily generated and transferred by making use of the luminance signal available in a processor as gradation data for the subsidiary sub-pixels without need for a complicated algorithm.

More specifically, the luminance signal before being converted into RGB values is used as gradation data for the subsidiary color sub-pixels without being processed. It is preferred to transfer this signal to a timing controller separately from the RGB signal thus converted.

Also, the color display device includes a display screen, a data processor and a display controller. The luminance information and color-difference information of an image to be displayed on the display screen is input to, or generated by, the data processor. The data processor generates primary color data signals on the basis of the luminance information and color-difference information. The display controller converts the luminance information and primary color information into data which can be displayed on the display. The RGB primary color data and subsidiary color sub-pixel data are separated and individually transferred to the display controller such as a timing controller from the data processor such as a processor.

The display controller may be provided with the function of a usual timing controller or a liquid crystal driver. A liquid crystal display controller may be located in an intermediate position as an interface between the processor and the liquid crystal driver and used to perform signal processing for displaying the liquid crystal display device to absorb the differences therebetween. The liquid crystal display controller receives an information signal from the processor, and converts the information signal into a signal, such as a display timing signal (display shift clock signal, frame signal and the like) or serial or parallel display data, appropriate for being output to the liquid crystal driver.

On the other hand, the liquid crystal driver is provided at the last stage for outputting display information transferred from the processor to the liquid crystal panel via the liquid crystal display controller. In other words, the liquid crystal driver serves to apply an appropriate voltage to each display segment or dot of the liquid crystal panel, i.e. each pixel or sub-pixel. The liquid crystal driver also serves to generate alternating square waves for driving the liquid crystal panel for the purpose of preventing the liquid crystal from being degraded, and output the alternating square waves to the liquid crystal panel.

The display control unit may be provided with correction data for gradation correction, and references the correction data to perform gradation correction. The timing controller serves, for example, to convert subsidiary color sub-pixel data into array data which can be used for displaying an image on the liquid crystal panel. In this case, the correction data is stored in a storage device in the form of look-up table for use in performing the correction of gradation levels.

In accordance with the present invention, the number of gradation levels can be substantially increased without increasing the number of gradation levels of the primary colors, or the resolution of the voltage applied to the color display panel by the LCD driver. Also, it is possible to provide a color display device and a color display method in which the data required for driving the subsidiary sub-pixels can be generated by a simplified process.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Figure 1A:
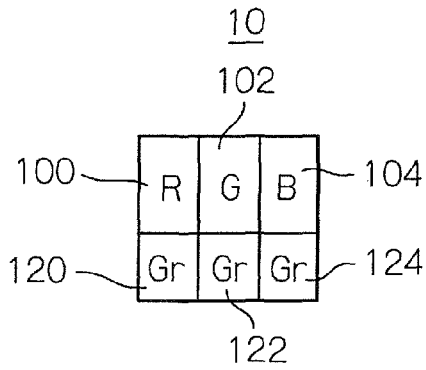
FIG. 1A explanatorily shows a set of sub-pixels forming a pixel of a liquid crystal display in accordance with an embodiment of the present invention.

With reference to the accompanying drawings, a color display device in accordance with a preferred embodiment of the present invention will be described in detail. The color display device of the present embodiment is implemented as a liquid crystal display device including a matrix of pixels, a graphics processor, a timing controller, and other necessary function units. Each individual pixel on the display screen 342, FIG. 6, of the liquid crystal display device is composed of a set of sub-pixels. Referring to FIG. 1A, a set of sub-pixels forming a pixel 10 includes sub-pixels 100, 102 and 104 for reproducing the three primary colors RGB, and subsidiary sub-pixels 120, 122 and 124 for reproducing subsidiary colors which are different from the three primary colors RGB.

Figure 1B:
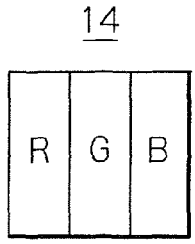
FIG. 1B PRIOR ART
FIG. 1B explanatorily shows a set of sub-pixels forming a pixel of a prior art liquid crystal display.

For comparison, a set of sub-pixels forming a pixel in a conventional technique is illustrated in FIG. 1B. In the following description, a sub-pixel is sometimes designated with a reference code assigned to the color of that sub-pixel of interest. The set of sub-pixels is repeatedly arranged in a matrix to form the LCD screen 342. In the case of the present embodiment, the subsidiary colors 120, 122 and 124 correspond to intensity information. Accordingly, in the case of the present embodiment, subsidiary color data is intensity data. The sub-pixels 120, 122 and 124 corresponding to the subsidiary colors are provided in association with the sub-pixels 100, 102 and 104 corresponding to the RGB primary colors respectively in each pixel.

The sub-pixels 120, 122 and 124 are arranged just below the three primary color sub-pixels as illustrated in FIG. 1A. The color reproduced by each of the sub-pixels 120, 122 and 124 is black, white, or any scale of gray. In the following, these colors are simply referred to as "gray," or Gr. Each of the sub-pixels 120, 122 and 124 changes in color simply from white to black with intensity variation. The sub-pixels 120, 122 and 124 are provided for the purpose of making an adjustment to the gradation levels of the three RGB primary colors 100, 102 and 104 respectively, and performing chromatic compensation and/or contrast enhancement of each or a combination of the three RGB primary colors 100, 102 and 104.

Accordingly, the color filter of each of the sub-pixels 120, 122 and 124 is a white filter. The white filter is not always necessary. However, it is preferable to appropriately select the white filter and place it on the sub-pixels 120, 122 and 124 to thereby adjust the spectrum characteristics of the back light passing therethrough from the light source of the liquid crystal display device.

Figure 2:
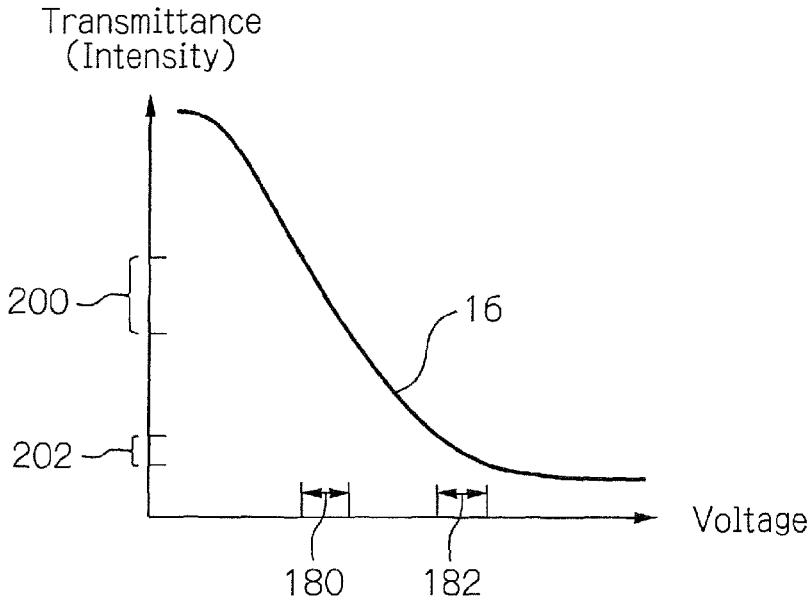
FIG. 2 exemplarily plots the relationship between the voltage applied to a sub-pixel and the intensity of light passing through the sub-pixel.

FIG. 2 is a graph for showing an example of the relationship between the voltage applied to a sub-pixel and the intensity of light passing through the sub-pixel. The graph is plotted with its abscissa representing the applied voltage and its ordinate representing the intensity to show an optical transmittance curve 16 with respect to the applied voltage. In this case, since the transmittance of the sub-pixel increases as the applied voltage decreases, this type is called normally white (NW). The reverse type is called normally black (NB).

Figure 3:
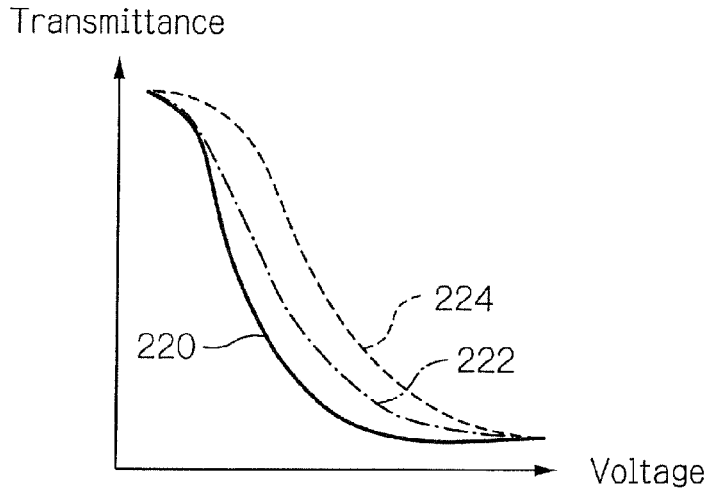
FIG. 3 plots intensity curves with respect to applied voltage for the three RGB primary colors.

The intensity is determined by the transmittance of the sub-pixel. As shown in the same figure, when the variation 200 of the intensity corresponding to the variation 180 of the applied voltage is compared to the variation 202 of the intensity corresponding to the variation 182 having the same width as the variation 180, it can be seen that the variation 200 is greater than the variation 202. The curve 16 of intensity vs. applied voltage varies depending upon the respective three RGB primary colors as illustrated in FIG. 3. FIG. 3 shows curves 220, 222 and 224 of intensity vs. applied voltage for the three RGB primary colors respectively. Also, in this case, the abscissa is the applied voltage, and the ordinate is the intensity. Incidentally, as described above, the number of gradation levels is determined by how fine the voltage supplied to the sub-pixels can be changed.

Figure 4:
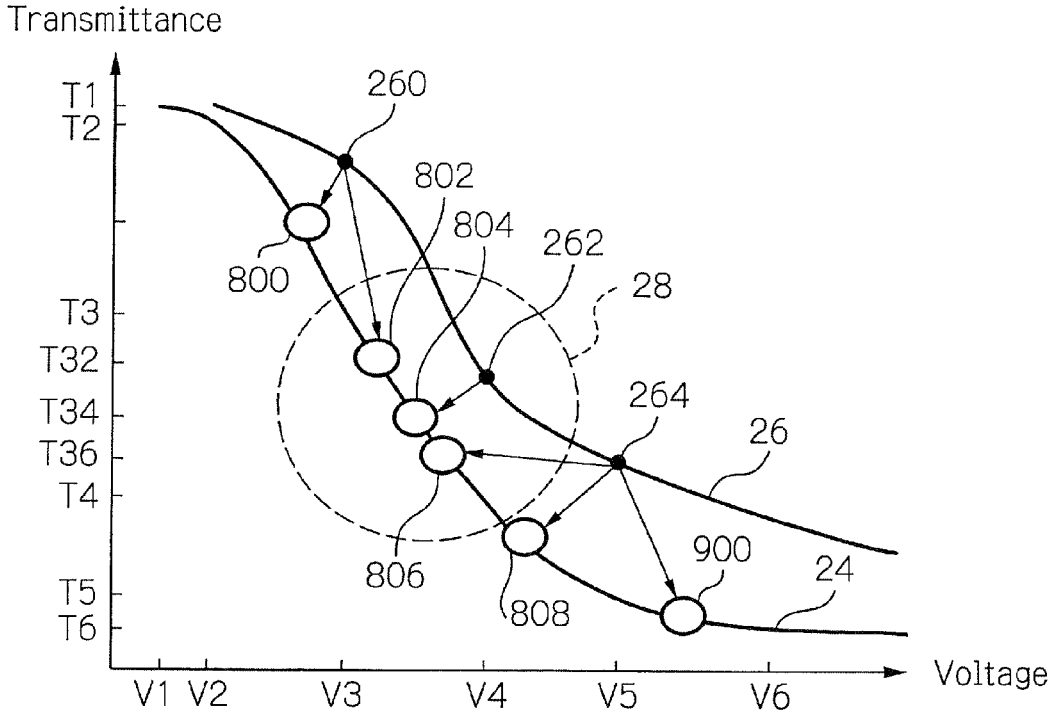
FIG. 4 plots a curve representing the optical transmittance of the sub-pixel corresponding to red and a curve representing the transmittance of a gray sub-pixel associated with the red sub-pixel.

In the case of the present embodiment, it is possible to interpolate between adjacent gradation levels of the three RGB primary colors by providing a gray sub-pixel for each of the three RGB primary colors as illustrated in FIG. 1A. FIG. 4 is a graphic representation showing the technical concept of the present invention. In the same figure, a curve 24 represents the transmittance of the sub-pixel corresponding to the red of the RGB primary colors, and a curve 26 represents the transmittance of the gray sub-pixel associated with the red sub-pixel. Voltages V1, V2, V3, V4, V5 and V6 are applied to the red sub-pixel and the associated subsidiary sub-pixel respectively, and the resultant transmittances T1, T2, T3, T4, T5 and T6 are obtained of the red sub-pixel. The solid circles on the curve 26 represent the transmittances 260, 262 and 264 of the gray sub-pixel associated with the red sub-pixel corresponding to the applied voltages V3, V4 and V5 respectively.

The transmittance versus voltage characteristics available by the additional use of the transmittance versus voltage characteristics represented by the curve 26 are shown, for descriptive purposes, by the open circles plotted on the curve 24. For example, in the case where a voltage of V5 is applied to the gray sub-pixel, additional transmittances 806, 808 and 900, shown in FIG. 4 as open circles, are obtained by combination of the red and the gray sub-pixels. Between the transmittances T3 and T4, three additional transmittances T32, T34 and T36 are obtained by applying voltages V3, V4 and V5 to the gray sub-pixel. The number of gradation levels is therefore substantially increased. This is schematically shown by arrows directed from characteristic points of the transmittance curve 26. In other words, the three characteristic points 260, 262 and 264 relating to the gray sub-pixel serve to generate additional three gradation levels between the adjacent characteristic points relating to the primary color sub-pixel. Only part of the arrows is shown in the chart in order not to make the illustration unnecessarily complicated.

The transmittance versus voltage characteristics of the respective RGB primary colors are combined with the transmittance versus voltage characteristics of the gray sub-pixel in order to increase the number of effective gradation levels. Then, for example, there are additional gradation levels as the three open circles depicted within a broken circle 28 between the transmittances T3 and T4. That is, the step between the adjacent transmittances on the solid line available without the use of the gray sub-pixels is divided by three points such as the characteristic points 802, 804 and 806.

While the six gradation levels corresponding to the transmittances T1 to T6 are finely divided by providing the subsidiary sub-pixel for the red color, the division is fully illustrated only in the region between the transmittances T3 and T4 in the case of the example shown in FIG. 4. In the case where three additional gradation levels are inserted by the subsidiary sub-pixel between each adjacent gradation levels, totaling to 15 gradation levels, 21 different transmittances become available.

In another example where 256 gradation levels, represented by eight bits, are controlled by an LCD driver for each of the RGB values, about 1678 million, i.e. 256*256* 256, colors can be increased to about 68.7 billion, i.e. 256 *16*256*16*256*16, colors by using a gray sub-pixel, which can generate 16 gradation levels, for each of the three RGB primary sub-pixels.

More specifically, it is easy to increase the number of colors without requiring a special specification of the LCD driver with respect to the variation of voltage. For example, in order to obtain one billion colors only with the three primary colors, it is necessary to design an LCD driver capable of outputting 1024 gradation levels, represented by ten bits. On the other hand, in accordance with the invention, an LCD driver capable of outputting only 64 gradation levels, represented by six bits, can meet this requirement with gray sub-pixels for generating 16 additional gradation levels between each adjacent gradation levels of each of RGB primary colors.

The three RGB primary colors can be individually finely adjusted by controlling the voltages applied to the gray sub-pixels in correspondence with the respective RGB colors. Incidentally, the data for determining the voltages applied to the gray sub-pixels is stored in the timing controller which supplies image data (gradation level data) to the LCD driver.

Figure 5A:
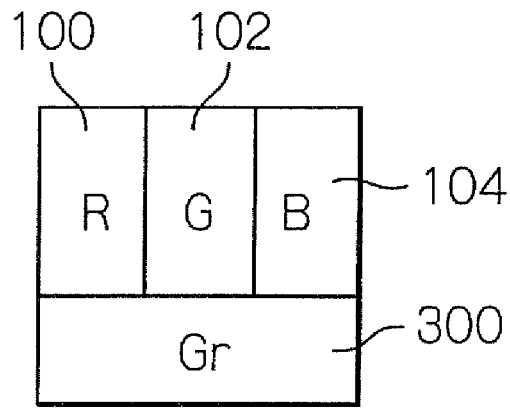
FIGS. 5A and 5B explanatorily show a set of sub-pixels forming a pixel of a liquid crystal display device in accordance with alternative embodiments of the present invention.
Figure 5B:
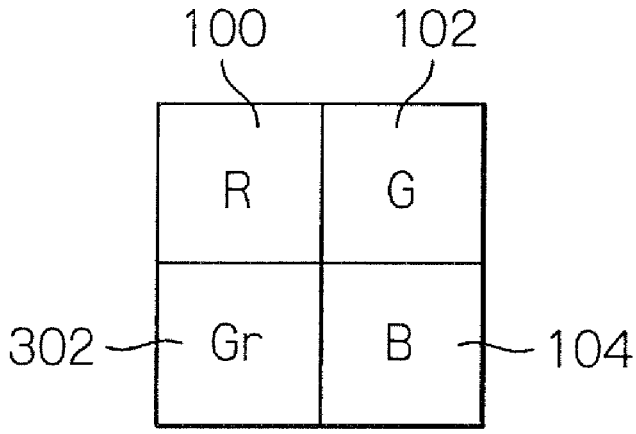

Furthermore, as illustrated in FIGS. 5A and 5B, the three gray sub-pixels provided for the respective RGB colors can be united with a single gray sub-pixel for the purpose of simplifying the overall configuration of the system and the LCD driver, and reducing the production cost. In this case, one gray sub-pixel 300 or 302 is provided for a set of the three RGB sub-pixels 100, 102 and 104. The gray sub-pixel 300 is provided aside of the bottoms of the three RGB sub-pixels 100, 102 and 104 as illustrated in FIG. 5A. Alternatively, as illustrated in FIG. 5B, the gray sub-pixel 302 may be located to form one of four squares arranged to form a large square in which the three RGB sub-pixels are located as the other three squares. This configuration simplifies the pixel arrangement and the manufacturing process of the LCD panel, such as the screen 342, FIG. 6. On the other hand, it is impossible to individually control the gray sub-pixels for each of the RGB colors.

The basic operation of this simplified system is similar to the operation of the system shown in FIG. 1A. However, when two or three of the RGB colors are lit, the gray sub-pixel is controlled to adjust the color obtained by the RGB combination rather than each of the RGB colors. Accordingly, in comparison to the case where a gray sub-pixel is provided for each of the three RGB primary colors as illustrated in FIG. 1A, the number of colors is reduced from about 68.7 billion (256*16*256 *16*256*16) colors to about 268 million (256*256*256 *16) colors, when each of RGB primary sub-pixels can generate 256 gradation levels and the gray sub-pixel can generate 16 gradation levels.

Figure 6:
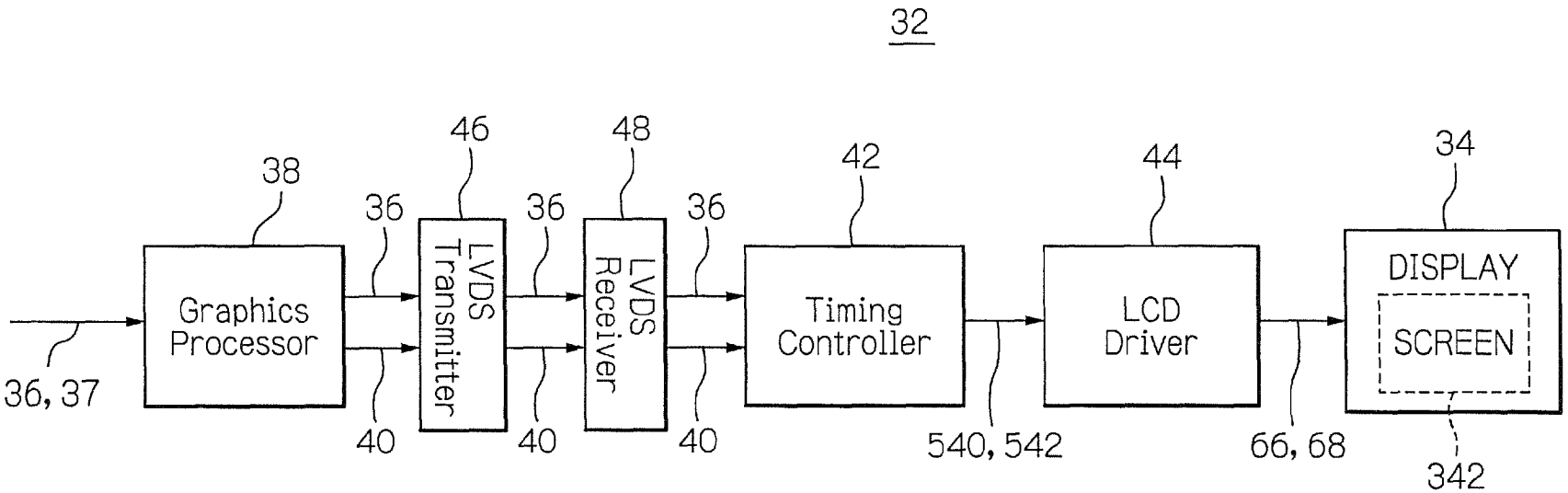
FIG. 6 is a schematic block diagram showing the configuration of a liquid crystal display device in accordance with the embodiment of the present invention.

Next, the intensity information to be supplied to the gray sub-pixels shown in FIGS. 1, 5A and 5B will be described with reference to FIG. 6. FIG. 6 is a schematic block diagram showing the configuration of the liquid crystal display device 32 in accordance with the embodiment of the present invention. In the liquid crystal display device 32, the intensity of an image to be displayed on a display 34 is represented by an intensity signal 36 which is input to the liquid crystal display device 32. The intensity signal for use in the liquid crystal display device 32 may be generated or adjusted within the liquid crystal display device 32. The liquid crystal display device 32 includes a graphics processor 38 which is adapted to receive image data comprising the luminance signal 36 and color-difference or chrominance signals 37 and convert these signals into RGB signals 40, which are then output together with the luminance signal 36. In this context, the intensity signal will sometimes be referred hereinafter to as luminance signal. Furthermore, the liquid crystal display device 32 includes a timing controller 42 and an LCD driver 44, which serves to convert the RGB signals 40 into corresponding data signals for displaying an image on the display 34. In what follows, the details will be described.

The graphics processor 38 is adapted to receive the luminance signal 36 and color-difference signals 37, convert these signals into the corresponding RGB signals 40, and output the RGB signals 40 to the timing controller 42 together with the luminance signal 36. The luminance signal 36 and color-difference signals 37 received by the graphics processor 38 are of the ratio of sampling frequency between the luminance signal (Y), i.e. 36, and color-difference signals (Cr, Cb), i.e. 37 equal to 4:2:2. Namely, the sampling frequency of the intensity signal (Y) 36 is twice as high as the sampling frequency of the color-difference signals (Cr, Cb) 37. The graphics processor 38 is adapted to convert the intensity signal (Y) 36 and color-difference signals (Cr, Cb) 37 received with sampling frequencies at the ratio of 4:2:2 into corresponding RGB signals to be output with sampling frequencies at a ratio of 4:4:4. Furthermore, the graphics processor 38 outputs the intensity signal (Y) 36 without conversion.

The luminance signal (Y) 36 output from the graphics processor 38 is used as the data for the subsidiary color sub-pixels. That is to say, the data for the subsidiary color sub-pixels can be supplied to the timing controller 42 without need for a complicated algorithm.

Between the graphics processor 38 and the timing controller 42, provided is a low-voltage differential signaling (LVDS) system, which comprises an LVDS transmitter 46 and an LVDS receiver 48 and is adapted to reduce the amplitude of input and output signals to several hundreds of millivolt in order to perform very high speed signal transmission at several hundreds of mega bps or higher. While the amplitude reduction makes signals more sensitive to noise, the effect of noise is reduced by employing the differential signaling system in place of a single-ended signaling system. On the other hand, radiation noise is reduced by virtue of the small amplitude, resulting in an electro-magnetic interference (EMI)-prevention design.

As has been discussed above, it is possible to easily obtain gradation signals for the sub-pixels of subsidiary colors by simply utilizing the luminance signal 36 which is input to the graphics processor 38. In addition, the luminance signal 36 is transmitted separately from the RGB signals 40 such that the timing controller 42 can receive the standard LVDS signals corresponding to the RGB signals.

Figure 7:
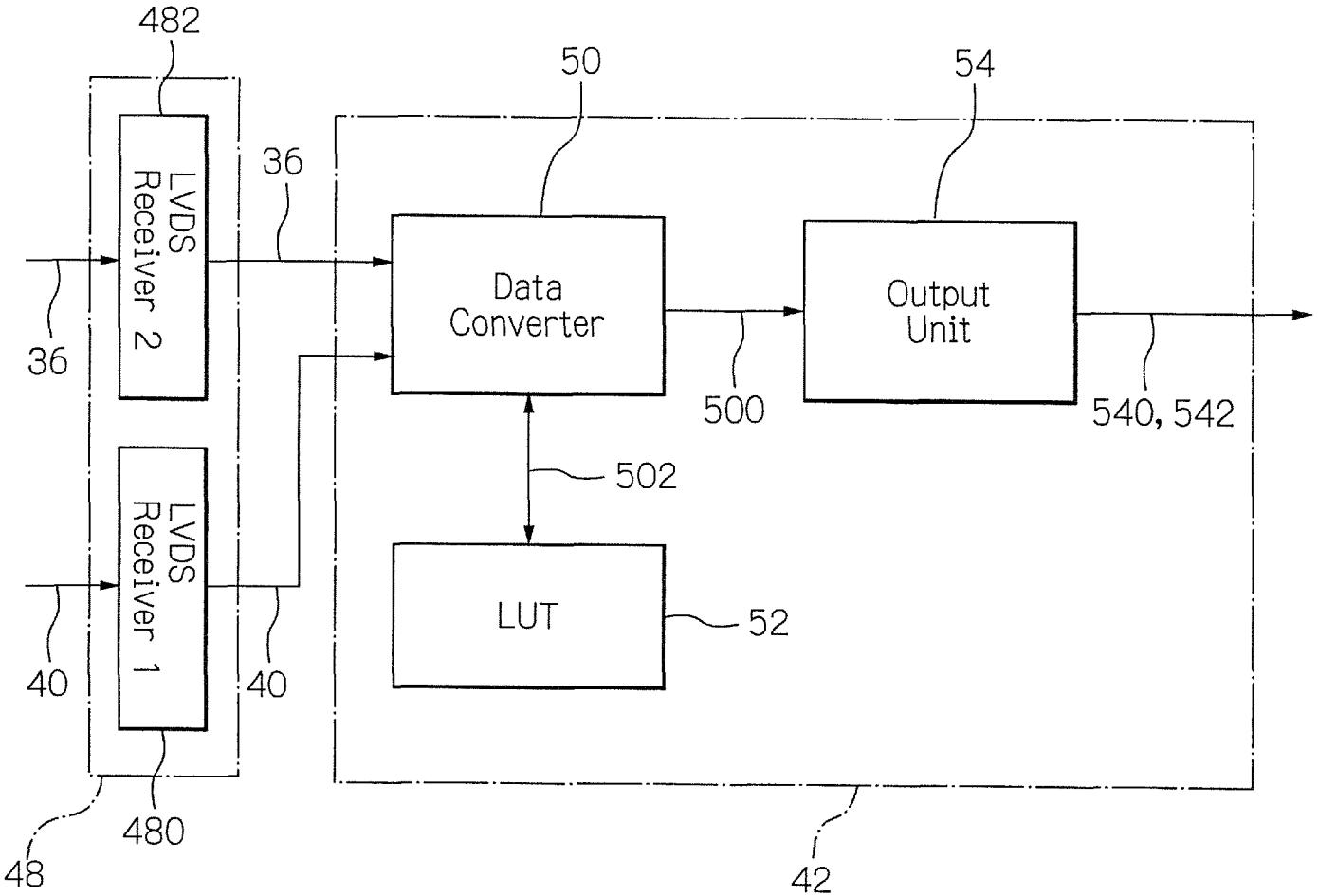
FIG. 7 is a schematic block diagram showing the configuration of a timing controller and the configuration of a low-voltage differential signaling (LVDS) receiver shown in FIG. 6.

FIG. 7 is a schematic block diagram showing the timing controller 42 and the LVDS receiver 48. The LVDS receiver 48 includes two types of LVDS receiver 480 and 482. The LVDS receiver 482 is adapted to receive the luminance signal 36 as data for use in driving the sub-pixels of subsidiary colors while the LVDS receiver 480 is to receive the RGB signals 40 for use in driving the RGB sub-pixels. When the subsidiary colors are not used, only the LVDS receiver 480 is driven. The LVDS receivers 480 and 482 output the data signals 36 and 40, respectively, to the timing controller 42 which includes a data converter 50 adapted to convert the data signals 36 and 40 in order to arrange the data signals 36 and 40 in an array such that the signals are displayed on each horizontal line of the display 34. Incidentally, the data converter 50 performs the data conversion and also serves to perform correction of the gradations of the data signals 36 and 40 by the use of a look-up table (LUT) 52, as described below.

The correction is performed for the following purpose. The data signals 36 for subsidiary colors as received by the timing controller 42 are sometimes not appropriate for use in the actual LCD device 34. For example, since the VT (transmittance versus voltage) characteristics vary between the RGB colors, there are differences between the gradation levels actually viewed and the gradation levels corresponding to the data signals. Because of this, the RGB values have to separately be corrected. The information required for correcting the data signals 36 and 40 are written to the look-up table 52 in advance. The information contains the voltage levels to be applied for the respective gradation levels, for example. The data converter 50 accesses the look-up table 52 through a signal line 502 in order to acquire necessary data and correct the input signals for displaying a desired color to be displayed.

The data converter 50 outputs the data which is converted and corrected to an output unit 54 over a signal line 500. The output unit 54 outputs the received data to a source driver 440, FIG. 8, of the LCD driver 44, FIG. 6, over a signal line 540 in accordance with RSDS (Reduced Swing Differential Signaling, a trademark of National Semiconductor Corporation) or mini-LVDS system. The timing controller 42 outputs a signal 542 which is used to drive a gate driver 442, FIG. 8, in the LCD driver 44.

Figure 8A:
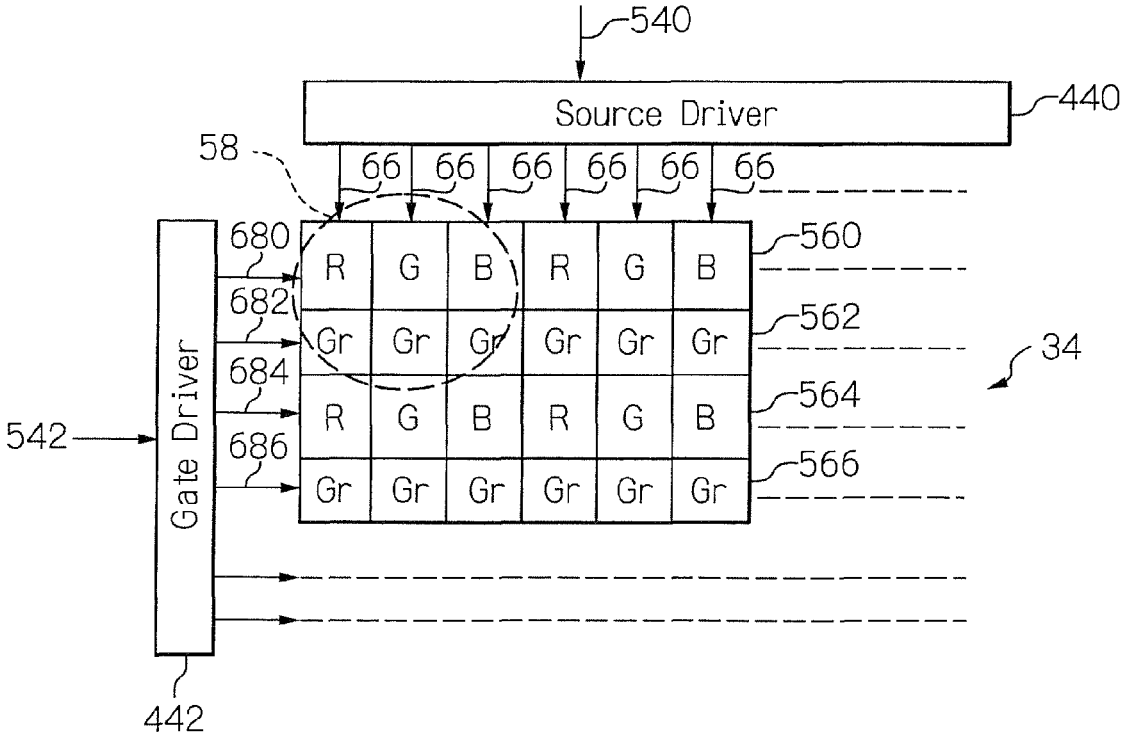
FIG. 8A is a schematic block diagram showing the LCD driver and display of the liquid crystal display device in accordance with the embodiment shown in FIG. 6.
Figure 8B:
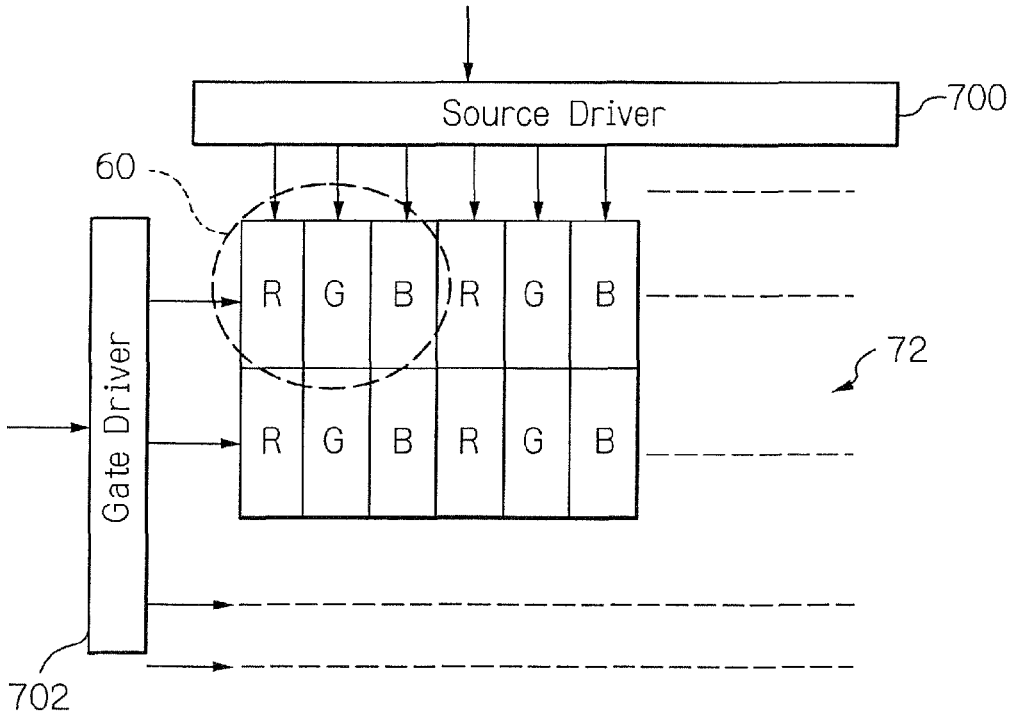
FIG. 8B PRIOR ART
FIG. 8B is a schematic block diagram showing the LCD driver and display of the prior art liquid crystal display device.

FIG. 8A is a schematic diagram showing an exemplified configuration of the LCD driver 44 for driving the display 34. The LCD driver 44 is composed of the source driver 440 and the gate driver 442. FIG. 8B is also a schematic diagram showing the configuration of a conventional LCD driver for driving a display 72 having no subsidiary sub-pixels. The conventional LCD driver is composed of a source driver 700 and a gate driver 702. In FIG. 8A, there are three RGB sub-pixels and three subsidiary color sub-pixels forming one pixel as illustrated with a dotted circle 58 in accordance with the present invention. Also, in FIG. 8B, there are three RGB sub-pixels forming one pixel as illustrated with a dotted circle 60 in the conventional LCD structure.

The timing controller 42, FIG. 6, receives the RGB data and subsidiary color data from the graphics processor 38, and outputs digital gradation level signals corresponding to the three RGB primary colors and subsidiary color to the source driver 440 of the LCD driver 44 over the signal line 540. After receiving the data, the source driver 440 supplies respective analog gradation voltages to the three RGB sub-pixels 100, 102 and 104 and three subsidiary color sub-pixels 120, 122 and 124.

The gradation voltages are supplied first to the three RGB sub-pixels 100, 102 and 104 as the RGB data signals by the source driver 440 over data lines 66 after selecting the respective sub-pixels 100, 102 and 104 on the first horizontal line 560 by the gate driver 442 through a gate line 680 in order to drive the first line 560. In the next step, the gradation voltages are supplied by the source driver 440 to the subsidiary color sub-pixels 120, 122 and 124 over data lines 66 after selecting the respective sub-pixels 120, 122 and 124 on the second line 562 by the gate driver 442 through a gate line 682 in order to drive the second horizontal line 562. These steps are successively repeated on the horizontal lines 564, 566 and so forth for one image frame, and then returning to the first horizontal line 560.

In the case of the present embodiment, it is possible to provide a color display device and a method in which the number of gradation levels can be substantially increased without increasing the number of gradation levels of the primary colors. The data required for driving the subsidiary sub-pixels can be generated by a simplified process.

The liquid crystal display device in accordance with the present invention is suitable particularly for an LCD panel, such as a display panel for an LCD television monitor, capable of expressing subtle color differences with a high accurate color reproducibility. Of course, the present invention can be effectively applied also to any other appropriate uses, for example, cellular phones, car navigation systems, DVD (Digital Versatile Disk) players and so forth.

Figure 9:
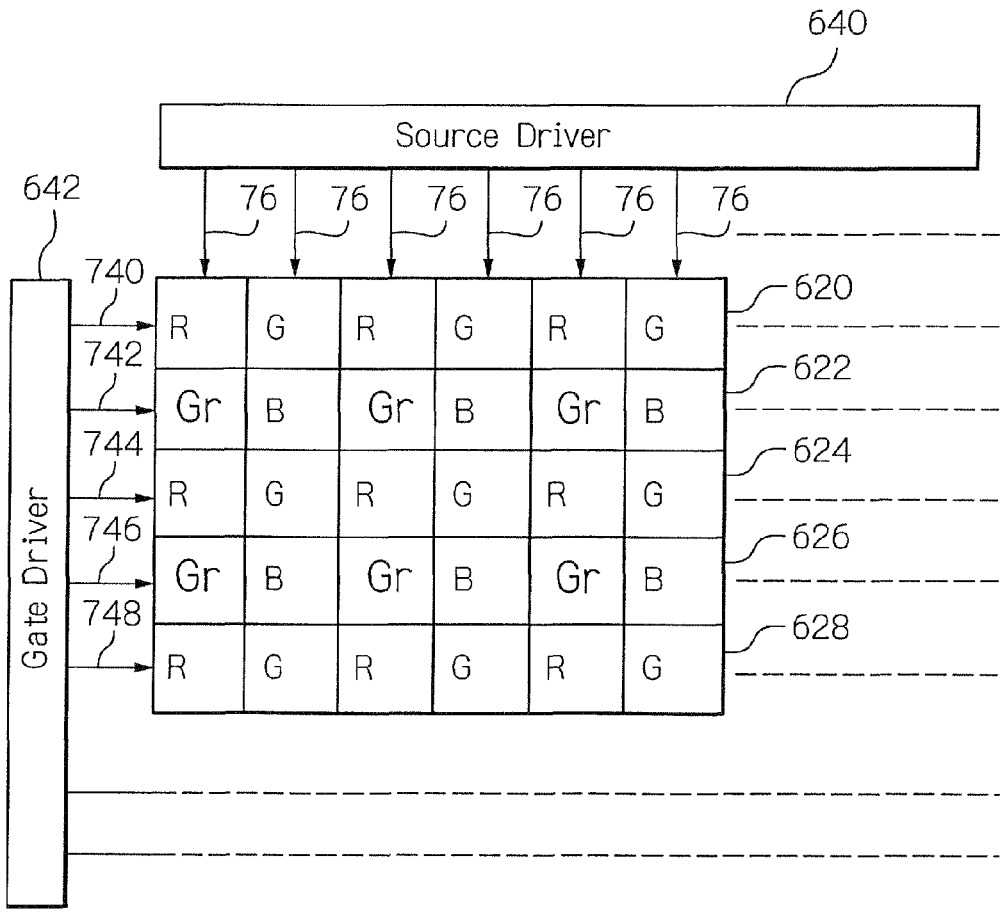
FIG. 9 is a schematic block diagram showing the LCD driver and display of the liquid crystal display device in accordance with the alternative embodiment of the present invention.

Now, FIG. 9 is a schematic diagram showing an exemplified configuration of the display 34 and an LCD driver comprising a source driver 640 and a gate driver 642 where the display 34 comprises pixels each of which is of the structure illustrated in FIG. 5B, i.e. comprises three RGB sub-pixels and one subsidiary sub-pixel.

More specifically in this structure, the gradation voltages are supplied first to the RG sub-pixels 100 and 102 by the source driver 640 over data lines 76 after selecting the respective sub-pixels 100 and 102 on the first horizontal line 620 by the gate driver 642 through a gate line 740 in order to drive the first line 620. In the next step, the gradation voltages are supplied by the source driver 640 to the primary color B sub-pixels 104 and subsidiary color sub-pixels 302 over data lines 76 after selecting the sub-pixels 302 on the second horizontal line 622 by the gate driver 642 through a gate line 742 in order to drive the second line 622. These steps are successively repeated on the lines 624, 626, 628 and so on for one image frame, and then returning to the first horizontal line 620. In accordance with this instant alternative embodiment, it is also possible to provide a color display device and a method in which the number of gradation levels can be substantially increased without increasing the number of gradation levels of the primary colors. Furthermore, the data required for driving the subsidiary sub-pixels can be generated by a simplified process.

The entire disclosure of Japanese patent application No. 2007-92526 filed on Mar. 30, 2007, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claimed is:

1. A method of controlling a color display device comprising a display screen having a plurality of pixels arranged in an array, each of the plurality of pixels including primary color sub-pixels for reproducing at least respective, three primary colors and at least one subsidiary color sub-pixel for reproducing a color different from the primary colors to increase a number of gradation levels of the primary colors of the primary color sub-pixels, comprising the steps of:

inputting into a processor or generating by the processor an original luminance signal and original color-difference signals determined from an original image which is desired to be displayed on the screen;

generating a primary color data signal for each of the primary color sub-pixels on a basis of the original luminance signal and original color-difference signals by the processor to output the primary color data signal to a timing controller together with the original luminance signal, the primary color data signal indicating a voltage to be applied to the primary color sub-pixel; and generating by the timing controller a subsidiary color data signal on the basis of the original luminance signal to output the subsidiary color data signal to a source driver of the screen together with the primary color data signals, the subsidiary color data signal indicating a voltage to be applied to the subsidiary color sub-pixel of the pixel having the primary color sub-pixel for which the primary color data signal is generated.

2. The method in accordance with claim 1, wherein the pixel consists of three primary color sub-pixels arranged in a first row and three subsidiary color sub-pixels arranged in a second row next to the first row, and the subsidiary color data signal is generated for the subsidiary color sub-pixel arranged in a same column of the primary color sub-pixel for which the primary color data signal is generated.

3. The method in accordance with claim 1, further comprising the step of separately transferring the original luminance signal and the primary color data signals from each other from the processor to the timing controller.

4. The method in accordance with claim 1, wherein the timing controller generates the subsidiary color data signal referring to correction data indicating suitable luminance of the subsidiary color sub-pixel for the primary color to be reproduced by the primary color data signal.

5. A method of displaying a color at a pixel of a display screen by a combination of at least three primary color sub-pixels for at least respective, three primary colors and at least one subsidiary color sub-pixel for reproducing a color different from the primary colors to increase a number of gradation levels of the primary colors of the primary color sub-pixels, comprising the steps of:

generating an original luminance signal and original color-difference signals determined from an original image which is desired to be displayed on the screen;

generating a primary color data signal for each of the primary color sub-pixels on a basis of the original luminance signal and original color-difference signals, the primary color data signal indicating a voltage to be applied to the primary color sub-pixel; and generating a subsidiary color data signal on the basis of the original luminance signal, the subsidiary color data signal indicating voltage to be applied to the subsidiary color sub-pixel of the pixel having the primary color sub-pixel for which the primary color data signal is generated;

wherein the pixel consists of three primary color sub-pixels arranged in a first row and three subsidiary color sub-pixels arranged in a second row next to the first row, and the subsidiary color data signal is generated for the subsidiary color sub-pixel arranged in a same column of the primary color sub-pixel for which the primary color data signal is generated.

6. The method in accordance with claim 5, wherein the subsidiary color data signal is generated with reference to correction data indicating a suitable luminance of the subsidiary color sub-pixel for the primary color to be reproduced by the primary color data signal.

7. A color display device comprising:

a display screen having plurality of pixels arranged in an array, each of the plurality of pixels including primary color sub-pixels for reproducing at least respective, three primary colors and at least one subsidiary color sub-pixel for reproducing a color different from the primary colors to increase a number of gradation levels of the primary colors of the primary color sub-pixels;

a processor for receiving or generating an original luminance signal and original color-difference signals determined from an original image which is desired to be displayed on the screen, and for generating a primary color data signal for each of the primary color sub-pixels on a basis of the original luminance signal and original color-difference signals, the primary color data signal indicating a voltage to be applied to the primary color sub-pixel; and a timing controller for receiving the primary color data signal from the processor together with the original luminance signal, and for generating a subsidiary color data signal on a basis of the original luminance signal to output the subsidiary color data signal to a source driver of the display together with the primary color data signal, the subsidiary color data signal indicating a voltage to be applied to the subsidiary color sub-pixel of the pixel having the primary color sub-pixel for which the primary color data signal is generated.

8. The color display device in accordance with claim 7, wherein each of said plurality of pixels comprises a plurality of the subsidiary color sub-pixels provided in a one-to-one correspondence with the primary color sub-pixels.

9. The color display device in accordance with claim 8, wherein the subsidiary color data signal is generated separately for each of the subsidiary color sub-pixels.

10. The color display device in accordance with claim 7, wherein said data processor separately transfers the original luminance signal and the primary color data signal from each other to said timing controller.

11. The color display device in accordance with claim 7, wherein said data processor is provided with correction data indicating suitable luminance of the subsidiary color sub-pixel for the primary color to be reproduced by the primary color data signal, and the data processor refers to the correction data to generate the subsidiary color data signal.

12. The color display device in accordance with claim 7, wherein the pixel consists of three primary color sub-pixels arranged in a first row and three subsidiary color sub-pixels arranged in a second row next to the first row, and the subsidiary color data signal is generated for the subsidiary color sub-pixel arranged in a same column of the primary color sub-pixel for which the primary color data signal is generated.

* * * * *